US005658431A

United States Patent [19]

Janson et al.

[11] Patent Number: 5,658,431

[45] Date of Patent: Aug. 19, 1997

[54] METHOD FOR PREVENTING YELLOWING OF LIGNOCELLULOSIC PRODUCTS

[75] Inventors: Jan Janson, Esbo; Ingegerd Forsskåhl, Vanda; Taina Korhonen, Espoo, all of Finland

[73] Assignee: Oy Keskuslaboratorio-Centrallaboratorium AB, Espoo, Finland

[21] Appl. No.: 425,396

[22] Filed: Apr. 20, 1995

[30] Foreign Application Priority Data

Apr. 20, 1994 [FI] Finland ..... 941815

[51] Int. Cl.[6] ..... D21H 17/36

[52] U.S. Cl. ..... 162/135; 162/158; 162/160; 162/164.1; 427/391; 252/301.21; 252/407

[58] Field of Search ..... 162/158, 160, 162/135, 164.1, 164.3; 427/391; 106/287.23, 287.26; 252/301.21, 407

[56] References Cited

U.S. PATENT DOCUMENTS 3,674,632 7/1972 Wennergren et al. ..... 162/164.1
4,474,919 10/1984 Polatajko-Lobos ..... 427/39.1

*Primary Examiner*—Peter Chin
*Attorney, Agent, or Firm*—Kubovcik & Kubovcik

[57] ABSTRACT

The invention relates to a method for protecting lignocellulosic material against yellowing caused by light or heat. The invention further concerns brightness stabilizing compositions intended for treatment of lignocellulosic materials. According to the invention, polytetrahydrofuran (PTHF) is used as the brightness stabilizing agent. Preferably PTHF having a molar mass of about 150 to 1500 is used. The invention provides a good stabilization of lignocellulosic pulp and of products containing such pulp, whereby the amount of PTHF required can be extremely small, e.g., 0.05–5% of the weight of the material.

14 Claims, 3 Drawing Sheets

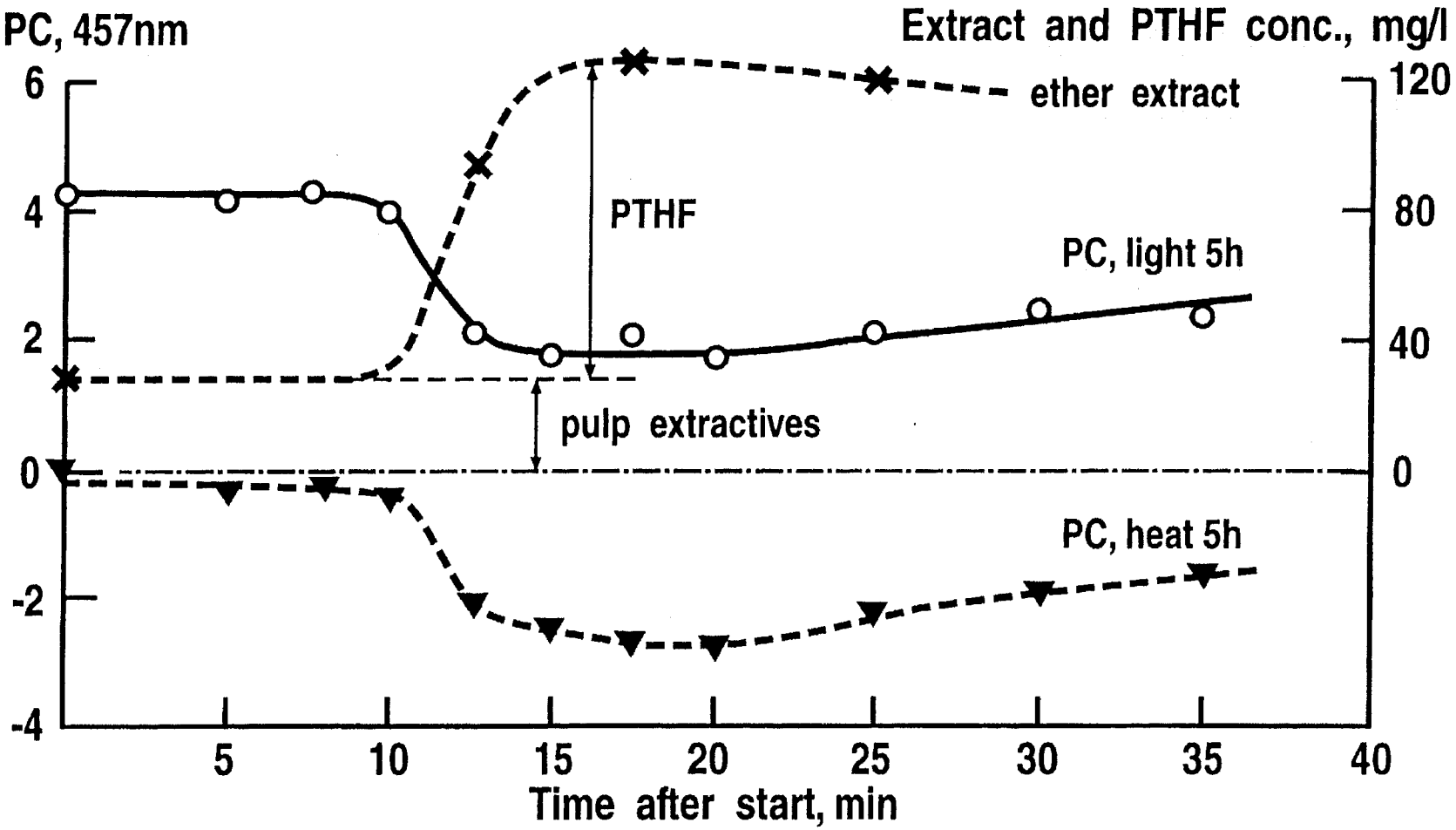
Fig. 2 PC-values of paper and ether extract content of white water from the paper machine run.

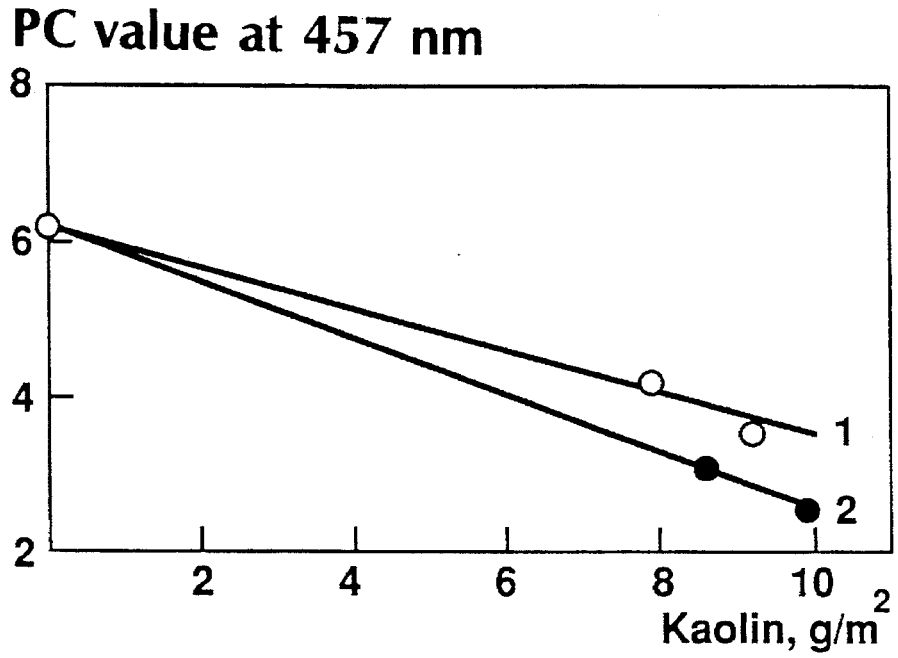
Fig. 3 PC-values for coated paper
1: Coating colour without PTHF
2: Coating colour with 0.158 g PTHF/g kaolin

METHOD FOR PREVENTING YELLOWING OF LIGNOCELLULOSIC PRODUCTS

BACKGROUND OF THE INVENTION

1. Field of the Invention

The present invention relates to a method for protecting lignocellulosic products, such as paper, cardboard, and the like, against yellowing, particularly yellowing caused by light and heat. According to such a method, the lignocellulosic product is treated with a brightness stabilizing agent.

The invention also relates to lignin-containing, uncoated papers, which are stabilized against yellowing caused by light and heat, as well as to surface treatment compositions which can be used to protect lignocellulosic products against yellowing.

2. Description of Related Art

As regards related art, reference is made to the following publications:

1. Gratzl, J. S.: Das Papier 39 (1985): 10A, V 14-V23.
2. Fischer, K.: Das Papier 44 (1990): 10A, V 11-V18.
3. Heitner, C.: Chapter 15, p. 192–204, ACS Symposium Series No. 531, ed. C. Heitner, J. C. Scaiano, ACS 1993.
4. Janson, J.: Das Papier 47 (1993): 10A, V47-V52.
5. U.S. Pat. No. 4,474,919

It is well-known in the art that light (UV light in particular), heat, moisture and chemicals can give rise to changes in the brightness of cellulose pulps. Usually, such changes result in reduced reflectivity, particularly in blue light. This phenomenon is known as yellowing and can be caused by various factors depending on which type of pulp is concerned. Heat and damp are the main causes of the yellowing of chemical (lignin-free) pulps, whereas mechanical pulps mostly yellow when they are exposed to light. The yellowing of mechanical pulps also varies depending on the raw material (type of wood), production method (with or without chemical pretreatment), and after-treatment (bleaching with different reagents) used. Thus, for instance, sulphonation and peroxide bleaching greatly increase the susceptibility of pulp to light-induced yellowing.

The yellowing of lignocellulosic pulps and products made from such pulps can be prevented in various ways, for instance by means of impregnation or surface treatment using UV screens, antioxidants, or polymers, or by coating the surface with a coating layer or a layer of non-yellowing chemical pulp.

Many of the additives which have been found to prevent yellowing are expensive or problematic from an environmental point of view; others are only effective when introduced in such large amounts that they may have a negative effect on other properties of the product or are uneconomical.

SUMMARY OF THE INVENTION

It is an aim of the present invention to remove the drawbacks of the prior art and to provide a new method of preventing yellowing.

The invention is based on the surprising observation that a polymer which has not been studied in this respect before, namely polytetrahydrofuran (PTHF), effectively prevents both light-and heat-induced yellowing.

Thus, according to the invention, polytetrahydrofuran is used as a brightness stabilizing agent.

The invention also provides a lignin-containing, uncoated paper, which contains 0.05 to 5% of polytetrahydrofuran and a composition for surface treatment of layers of lignocellulosic material, containing 1 to 150 parts by weight of a solvent, 0.01 to 200 parts by weight of known viscosity-increasing agents and/or hydrophobicity-increasing reinforcement agents, and 1 to 30 parts by weight of polytetrahydrofuran.

BRIEF DESCRIPTION OF THE DRAWINGS

FIG. 2 shows the relationship between the PTHF content and PC values of paper made from reinforced thermomechanical pulp (TMP), PTHF having been added into the stock during production, and FIG. 3 indicates the PC values of sample sheets treated with PTHF-containing coating colours as a function of the amount of PTHF in the mix; curve 1: mix with no PTHF content, curve 2: mix with 0.158 g PTHF per g kaolin.

DETAILED DESCRIPTION OF THE INVENTION

Figure 1:
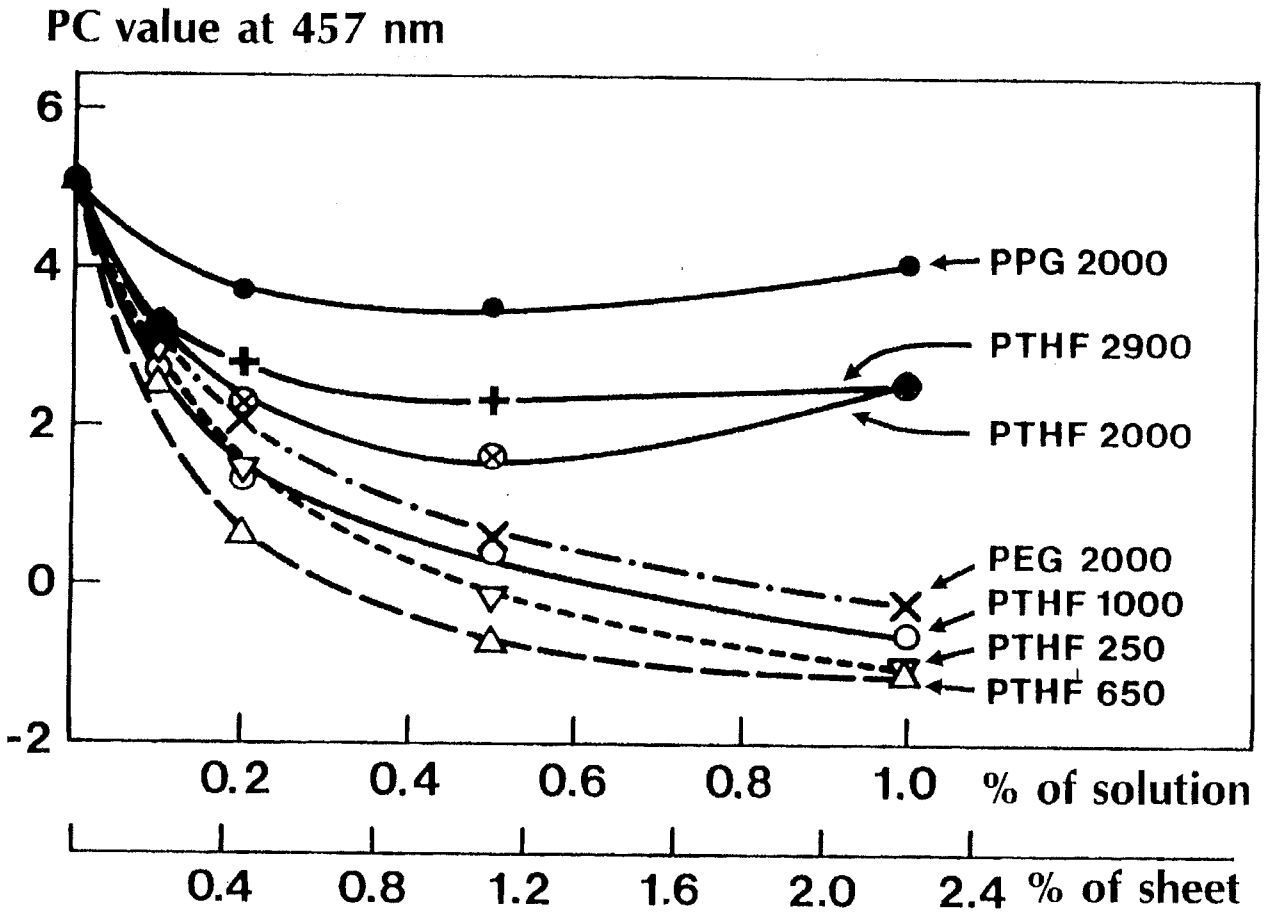
FIG. 1 indicates the Post Colour (in the following abbreviated "PC") values for sample sheets as a function of the respective amounts of polyethylene glycol and polytetrahydrofuran contained in the sheet.

Within the scope of the present invention, the term "lignocellulosic material" denotes products based on, containing, or comprised of mechanical cellulose pulps (e.g., mechanical pulp, thermomechanical pulp) or semi-mechanical (e.g., chemi-mechanical) pulps still containing significant amounts of lignln or lignin derivatives. Thus, the present invention can be employed for preventing yellowing of various paper pulps as well as of paper and board. The invention is even suited for treating pulps partly containing chemical pulps as, e.g., reinforcing pulps, and products made therefrom. According to a preferred embodiment, LWC or SC-type products which are stabilized against yellowing caused by heat and light are produced.

The expressions "brightness stabilization" and "prevention of yellowing" are used interchangeably in the present context.

"Lignin-containing, uncoated paper" denotes paper products of the above-mentioned kind (i.e. still containing at least some lignin) not coated with coating compositions containing significant amounts of pigments. As examples of this kind of papers, newsprint and base papers for coating can be mentioned.

The polymer which is utilized in the present invention and which was referred to as "polytetrahydrofuran" above may also be called poly(oxytetramethylene) glycol (PTMG), polytetramethylene ether glycol (PTMEG), or polybutylene glycol. The name recommended by IUPAC is α-Hydro-ω-hydroxypoly(oxy-1,4-butanediyl), Chemical Abstracts No. 25190-06-01.

The use of PTHF in coating colours has been suggested previously. Thus, U.S. Pat. No. 4,474,919 discloses a method for regulating the viscosity of coating compositions containing a latex which swells in alkali, based on adding a suitable amount of a poly-$C_2$-$C_4$-alkylene glycol. In the prior art publication there is no teaching or even suggestion that the coating colour could be used for achieving brightness stabilization of paper.

PTHF of low molar mass (e.g., 250) is a liquid, it is colourless and soluble in water, whereas PTHF of higher molar mass (e.g., 650 and higher) is waxy and has a low melting point (25° to 35° C.). It is colourless and poorly soluble in water. The acute toxicity is very low and PTHF is classified as not causing irritation of the eyes and skin. It is used industrially as a component in elastic and thermoplastic polymers, such as polyurethane fibres, glue, and rubber-like products.

PTHF has the general formula

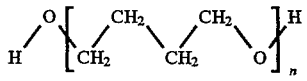

wherein n is an integer greater than 1.

According to the invention, the brightness stabilizing agent for lignocellulosic material preferably comprises polytetrahydrofuran whose molar mass is about 150 to about 1500 (in the above formula, n is an integer from 2 to 20, preferably 15 at the most, corresponding to a molar mass of about 1200). Polytetrahydrofuran exhibiting higher molar masses also produces a brightness stabilizing effect which, however, is somewhat smaller than the corresponding effect of the low-molar mass polymer, which is also apparent from the results indicated in Example 1. In some cases (see Example 3) a better brightness stabilization against heat-induced yellowing can be obtained by using a PTHF with higher molar mass.

The polytetrahydrofuran can be introduced by means of a surface treatment, such as surface sizing, spraying, or pigment coating, or it can be applied by impregnation or by introduction into the pulp stock.

The coating compositions can be based on solvents such as alcohols, e.g., methanol, ethanol, n-propanol, or isopropanol. Mixtures of solvents can also be used and the term "solvent" as used in connection with the present invention also covers mixtures of different solvents.

However, it is not necessary to dissolve PTHF in an alcohol or a mixture thereof for application; it can equally well be dispersed into water using a surface active agent. Similarly, PTHF, dispersed in a solvent (or rather dispersion medium) or a mixture thereof, preferably water, can be admixed into the pulp before producing the paper.

The simplest way of applying the PTHF is to subject the paper to surface treatment in, e.g., a surface sizing apparatus connected to a paper machine. During surface treatment, a dispersion or solution is preferably used containing about 1 to about 40%, advantageously about 5 to 30% PTHF calculated on the basis of the total weight of the dispersion or the solution, possibly together with dispersing agents and viscosity-increasing agents. In the present context, the term "surface sizing" is used to designate application methods where PTHF is applied onto the paper surface by means of a roll. A typical surface sizing composition can, in addition to the above-cited components (water and PTHF+possibly dispersing agents), also contain known components which give rise to hydrophobicity (reinforcing agents), such as starch and starch derivatives, and viscosity-increasing agents. Typically, a composition suited to surface sizing contains about 50 to 150 parts by weight of a solvent and 1 to 30 parts by weight of polytetrahydrofuran. The concentration of the PTHF can amount to 1 to 30% by weight, and the application dosage is about 0.1 g to 3 g/m$^2$.

If the polytetrahydrofuran is applied in the form of a coating mix or coating colour known per se, it is preferred to use a composition which contains about 50 to 150 parts by weight of at least one pigment, about 5 to 30 parts by weight of at least one binding agent, 0 to 10 parts by weight of other additives known per se, and 1 to 30 parts by weight of PTHF, such that the concentration of the last-mentioned component in the coating mix advantageously amounts to about 1 to 40%, preferably about 5 to 30% of the weight of the pigment.

The coating colours may contain water and components known per se, such as pigments and binding agents. Suitable light-scattering pigments are exemplified by calcium carbonate, calcium sulphate, aluminium silicate and aluminium hydroxide, aluminium magnesium silicate (kaolin), titanium dioxide and barium sulphate as well as mixtures of said pigments. Even synthetic pigments can be used.

The binding agents may be constituted by binding agents known per se which are conventionally used in the production of paper for the preparation of coating mixes. Beside individual binding agents, combinations of different binding agents can be used. As typical examples, synthetic latexes may be cited which are composed of polymers or copolymers of ethylenically unsaturated compounds, e.g., butadiene-styrene copolymers which possibly further contain a comohomer having a carboxyl group such as acrylic acid, itaconoic acid, or maleic acid, and polyvinyl acetate which contains a comonomer with carboxyl groups. Binding agents which can be used together with the above-listed agents are comprised of starch or casein, polyvinyl alcohol and polymers of low molecular weight having carboxyl groups (particularly polycarbonates which can act as dispersing agents at the same time, and which bind iron ions).

The product which is to be treated with PTHF may be previously untreated or it may have been subjected to a treatment known per se, for instance surface sizing, impregnation or coating, during a previous treatment step.

Other brightness stabilizing agents, for instance such as the ones mentioned in the publications cited in the introduction of the description, can be used together with PTHF. According to a particularly advantageous embodiment, PTHF is incorporated in the stock pulp, while the surface of the paper is treated with polyethylene glycol (PEG); see Example 3. Such a surface treatment may be effected as is described above for PTHF, for instance by surface sizing, spraying, or coating.

Example 6 describes the combined use of PTHF and anisyl alcohol. As examples of other brightness stabilizing agents, sodium gluconate and glucitol may be cited.

The invention provides the benefit that a good stabilization of lignin-containing pulp is obtained, as well as of products containing such pulp. The amount of PTHF required to obtain this benefit may be very small, e.g., 0.05 to 5% by weight. For the purpose of impregnation, at least 0.2% (calculated on basis of the weight of the material) preferably about 0.5 to 2.5% by weight is added. In the case of surface treatment, the required amount is further reduced. Thus, if the surface weight of the material being treated is, e.g., 50 g/m$^2$, a corresponding PTHF content of the surface layers susceptible to yellowing (10 to 15 g/m$^2$ on both sides) can be obtained by using half the above amount, that is, about 0.3% of the sheet weight. An even smaller PTHF content is effective. An amount of 0.2% of the surface layer in Example 1 below is obtained by 0.1% PTHF of the sheet weight, that is, 1 kg per ton paper. Calculated on the surface weight, this equals 0.025 g/m$^2$. Consequently, the limits for economically interesting quantities of polytetrahydrofuran applied using surface treatment methods may be set at approximately 0.1 to 3.0% by weight, preferably about 0,1 to 1% by weight.

Next, the invention will be examined in further detail with the help of non-limiting exemplifying embodiments.

Methods

In small-scale laboratory experiments, 45×55 mm pieces of sheet were used with a surface weight of about 400 g/m$^2$, made from ground wood of spruce. The pieces were weighed, impregnated for 5 min. with PTHF dissolved in ethanol, reweighed and dried. The amount of applied PTHF was calculated on the basis of the weight of the amount of absorbed solution. The brightness and Y value of the sample were measured and the samples were subsequently exposed to irradiation for 5 h in a Suntest CPS (Heræus-Hanau) whereafter brightness and Y value were remeasured. The PC values were calculated and used to calculate the magnitude of yellowing. Some samples were subjected to treatment in a heating chamber instead of an irradiation treatment, and were kept in darkness at a temperature of 80° C. and a relative humidity (RH) of 65% for a period of one hour, and were subsequently dried in darkness for 1 h at 25° C. and 20% RH. The measurements were conducted in the manner described above.

Paper made from 90% spruce TMP and 10% bleached pine sulphate pulp was produced using an experimental paper machine. The operating speed was 80 m/min, the width of the web (trimmed width) 60 cm and surface weight 60 g/m$^2$. At a predetermined point of time, a water suspension of PTHF 650 was added to a certain portion of the stock, 5% of the pulp dry weight (whereof a maximum of 2% was retained by the paper and the remaining 3% circulated in the white water precipitating PTHF in a decreasing content even long after the pulp directly treated with PTHF had run out and been replaced with untreated pulp).

In the surface sizing experiments, a cylindrical laboratory coating unit CLC 6000 (Sensor & Simula) was used together with, on the one hand, a commercially available writing paper having a surface weight of 70 g/m$^2$ and containing 85% of bleached ground wood of spruce, and, on the other hand, a paper from an experimental paper machine having a surface weight of 60 g/m$^2$ and containing 90% of spruce TMP.

EXAMPLE 1

Effect of PTHF on light-induced yellowing

Tests conducted using different fractions and different concentrations show (FIG. 1) that PTHF is extremely effective in preventing light-induced yellowing; with a concentration of 0.7% of PTHF 650 calculated on the basis of the sheet weight, full stability was obtained under the prevailing irradiation conditions which involved exposure to strong irradiation. As a reference, the results of corresponding tests with polyglycol (PEG 2000) are shown, this polymer having been found to have a good stabilizing effect against light-induced yellowing; see, e.g., I. Forsskähl, J. Janson: Paperi ja Puu 74 (1992):7, 553–559. It is obvious that PTHF 650 is about twice as effective as PEG 2000, that is, only half the amount is needed for the same effect.

The best protection is obtained using PTHF of low molar mass (250 to 650).

EXAMPLE 2

Treatment of ground wood

Ground wood having a 2.5% consistency in water was mixed with 1% PTHF 650, calculated on the water, at 45° C. for 2 h. The pulp was subjected to sheet formation on a B üchner funnel. Analogously, a zero test was carried out without PTHF. The PC values were as shown below:

TABLE 1

PC values for ground wood

| Sample | PC, 457 nm, irradiated |
|---|---|
| Untreated | 3.66 |
| Treated with PTHF 650 | −0.62 |

This experiment shows that PTHF is effective even when mixed directly into the pulp without the use of organic dissolvents or detergents. The material is sparingly soluble in water and, therefore, it is retained on the pulp during papermaking.

EXAMPLE 3

Treatment of ground wood on a paper machine

The principle of the above example was implemented on a greater scale when a 60 g/m$^2$ paper containing 90% spruce TMP and 10% bleached pine kraft pulp was made on an experimental papermaking machine. PTHF 650 was added into the pulp during a 13-minute period.

The paper was most stable when the PTHF concentration in the paper was at its maximum (approximately 2%, determined from extracts of the white water), see FIG. 2. The PC value after 5 h of irradiation had been considerably reduced and the PC values after 1 h and 5 h of aging in darkness, which in the case of untreated paper were approximately 0, turned negative, that is, the paper was bleached during aging in darkness. Thus, PTHF had an extremely advantageous effect on yellowing.

EXAMPLE 4

Coating of PTHF treated paper with PEG

A piece of the best stabilized paper in Example 3 (Sample No. X 200 in Table 2 below) was coated with a surface layer of PEG 2000 in the laboratory coater CLC 6000 to a concentration of 174 g/m$^2$ (Sample No. X201 in Table 2). This further improved the stability of the paper in such a way that after irradiation, it was even lighter than the base paper was before exposure (Sample No. X 000, without PTHF and PEG, in Table 2). In one case, the surface sizing compositions contained starch as the reinforcing agent and hydrophobicity-creating agent (oxidized starch, RA 302 E, Raisio Oy, Finland) and in all cases, they contained Xanthan gum (19 mg/m$^2$) as a viscosity-increasing agent.

TABLE 2

Brightness values ($R_\infty$ at 457 nm) for papper containing PTHF, PEG and starch

| Sample No. | PTHF, g/m$^2$ | PEG, g/m$^2$ | Starch, g/m$^2$ | Brightness ($R_\infty$, 457 nm) prior to irradiation | Brightness ($R_\infty$, 457 nm) after irradiation |
|---|---|---|---|---|---|
| X 000 | 0.0 | 0.0 | 0.00 | 56.1 | 52.8 |
| X 200 | 1.2 | 0.0 | 0.00 | 58.3 | 54.8 |
| X 201 | 1.2 | 1.4 | 0.00 | 59.5 | 57.3 |
| X 203 | 1.2 | 1.4 | 0.19 | 60.0 | 57.8 |

The example illustrates the advantages obtained by using a combination of PTHF and PEG.

EXAMPLE 5

Surface sizing of writing paper with mixtures containing PTHF

Writing paper was surface sized using a mixture containing 9.6% PTHF 650 disperged in water with 2.4% Teepol.

Both surface sized and untreated paper samples were irradiated and subjected to heat treatment. The results are given as the following total PC values:

TABLE 3

PC values for writing paper treated with PTHF

| Sample | PTHF Type | PTHF % | Other additives | PC values, 457 nm irradiated | PC values, 457 nm heat treated |
|---|---|---|---|---|---|
| 1 | — | — | — | 6.23 | 0.16 |
| 2 | — | — | 9.6% Teepol + 2.0% CMC | 6.03 | 0.23 |
| 3 | 1000 | 9.6 | 2.4% Teepol | 5.45 | −0.13 |
| 4 | 650 | 19.2 | 9.6% Teepol + 2.0% CMC | 4.83 | 0.32 |

Thus, surface sizing with PTHF resulted in a distinct improvement in the brightness stability of the paper.

EXAMPLE 6

Coating of writing paper with coating colours containing PTHF

Writing paper was coated using a normal coating mix (60% dry content, 100 parts kaolin+8 parts styrene-butadiene latex+1 part CMC) with and without additions of PTHF 650. The results graphically displayed in FIG. 3 indicate that PTHF provides protection against yellowing even in the coating layer.

EXAMPLE 7

Brightness stabilization with combinations of PTHF and anisyl alcohol

That PTHF can be combined with known stabilizing agents other than PEG is evident from the following experiments where anisyl alcohol was introduced to sheets made from mechanical pulp.

TABLE 4

PC values for mechanical pulp treated with combinations of PTHF and anisyl alcohol

| Sample | Additives | Concentr. in ethanol solution % | PC, 457 nm, irradiated |
|---|---|---|---|
| 1 | — | — | 3.29 |
| 2 | PTHF 650 | 0.25 | 0.97 |
| 3 | Anisyl alcohol | 0.25 | 2.40 |
| 4 | PTHF 650 + anisyl alcohol | 0.25 + 0.25 | 0.75 |

We claim:

1. A method for protecting mechanical pulp material or chemi-mechanical pulp material against yellowing, comprising:

applying a brightness stabilizing agent to said material in an amount effective to increase a resistance to yellowing of the material;

wherein said brightness stabilizing agent comprises polytetrahydrofuran and said effective amount is 0.05 to 5% by weight of the polytetrahydrofuran based on the weight of the material.

2. The method according to claim 1, wherein said polytetrahydrofuran has a molar mass of about 150 to about 1500.

3. The method according to claim 1, wherein said material is in a form selected from the group consisting of paper pulp, paper and board.

4. The method according to claim 1, wherein polytetrahydrofuran is applied by means of a surface treatment selected from the group consisting of surface sizing, spraying and pigment coating.

5. The method according to claim 4, wherein polytetrahydrofuran is applied in the form of a water dispersion or solution containing about 1 to about 40% of PTHF of the total weight of the dispersion or solution and said solution further comprises at least one member of the group consisting of dispersing agents and viscosity-increasing agents.

6. The method according to claim 4, wherein polytetrahydro-furan is applied-in the form of a coating mix containing pigments and binding agents, whereby the content of polytetrahydrofuran in the coating mix amounts to about 1 to about 40% of the weight of the pigment.

7. The method according to claim 1, wherein polytetrahydrofuran is applied by impregnation.

8. The method according to claim 1, wherein polytetrahydrofuran is admixed into pulp stock.

9. The method according to claim 1, comprising treating the material by impregnation and further comprising applying polytetrahydrofuran in an amount of 0.5 to 2.5 by weight based on the weight of the material.

10. The method according to claim 1, comprising treating the material by surface sizing or coating and further comprising applying polytetrahydrofuran in an amount of 0.2 to 3.0% by weight based on the weight of the material.

11. The method according claim 1, wherein polytetrahydrofuran is applied in combination with other brightness stabilizing agents.

12. The method according to claim 11, wherein polytetrahydro-furan is applied in combination with polyethylene glycol.

13. The method according to claim 8, further comprising applying polyethylene glycol onto the surface of the paper pulp.

14. A lignin-containing, uncoated paper, comprising a sheet of a mechanical pulp or chemi-mechanical pulp and containing 0.05 to 5%, calculated on basis of the weight of the paper, of polytetrahydrofuran.

* * * * *